US006679960B2

(12) United States Patent
Jones

(10) Patent No.: US 6,679,960 B2
(45) Date of Patent: Jan. 20, 2004

(54) ENERGY DENSE EXPLOSIVES

(75) Inventor: John W. Jones, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 188 days.

(21) Appl. No.: 09/840,909

(22) Filed: Apr. 25, 2001

(65) Prior Publication Data

US 2003/0015265 A1 Jan. 23, 2003

(51) Int. Cl.[7] ..... C06B 45/10; C06B 45/14
(52) U.S. Cl. ..... 149/19.3; 149/19.1; 149/18
(58) Field of Search ..... 149/18, 19, 19.1, 149/19.3, 17

(56) References Cited

U.S. PATENT DOCUMENTS

| | | | | |
|---|---|---|---|---|
| 2,009,556 A | | 7/1935 | McNutt | |
| 2,708,623 A | | 5/1955 | Franz | |
| 3,423,259 A | | 1/1969 | Staba | |
| 3,507,719 A | | 4/1970 | Hodgson | |
| 3,611,939 A | | 10/1971 | Stadler | |
| 3,706,608 A | | 12/1972 | Geisler | |
| 3,725,516 A | | 4/1973 | Kaufman | |
| 3,745,077 A | | 7/1973 | Jones | |
| 3,788,908 A | | 1/1974 | Lehikoinen et al. | |
| 3,865,035 A | | 2/1975 | Munson et al. | |
| 3,869,320 A | | 3/1975 | Brett et al. | |
| 3,919,013 A | | 11/1975 | Fox et al. | |
| 3,961,576 A | * | 6/1976 | Montgomery, Jr. | 102/67 |
| 4,000,022 A | | 12/1976 | Beckert et al. | |
| 4,001,057 A | | 1/1977 | Baldwin et al. | |
| 4,019,932 A | | 4/1977 | Schroeder | |
| 4,060,435 A | | 11/1977 | Schroeder | |
| 4,104,093 A | | 8/1978 | Yamaji | |
| 4,318,344 A | | 3/1982 | Price et al. | |
| 4,331,080 A | | 5/1982 | West et al. | |
| 4,424,086 A | | 1/1984 | Christopher | |
| 4,484,960 A | | 11/1984 | Rucker | |
| 4,675,059 A | | 6/1987 | Mei | |
| 4,747,892 A | | 5/1988 | Spencer | |
| 4,915,618 A | * | 4/1990 | Brandin | 431/267 |
| 5,139,587 A | | 8/1992 | Strecker et al. | |
| 5,143,566 A | | 9/1992 | Strecker et al. | |
| 5,385,098 A | | 1/1995 | Lindqvist et al. | |
| 5,429,691 A | | 7/1995 | Hinshaw et al. | |
| 5,439,537 A | | 8/1995 | Hinshaw et al. | |
| 5,529,649 A | | 6/1996 | Lund et al. | |
| 5,567,906 A | | 10/1996 | Reese et al. | |
| 5,650,590 A | | 7/1997 | Taylor | |
| 5,700,974 A | | 12/1997 | Taylor | |
| 6,105,503 A | | 8/2000 | Baginski | |
| 6,225,519 B1 | * | 5/2001 | Matsunaga | 588/200 |

FOREIGN PATENT DOCUMENTS

EP 334725 A1 * 9/1989

OTHER PUBLICATIONS

International Search Report.

* cited by examiner

*Primary Examiner*—John Hardee
(74) *Attorney, Agent, or Firm*—Burns, Doane, Swecker & Mathis, LLP

(57) ABSTRACT

The present invention is directed to EDE (Energy Dense Explosives), wherein particles of a reducing metal and a metal oxide are dispersed throughout a conventional high explosive. When the resulting EDE is detonated, the reducing metal and the metal oxide combine in an exothermic redox reaction at a speed on the order of a detonation speed of the conventional explosive. The resulting formulation has higher mass per unit volume and energy per unit volume densities than the conventional high explosive alone. Sizes of the reducing metal particles and metal oxide particles and proximities of the particles to each other within the conventional explosive can be adjusted to tailor blast characteristics of a munition, for example to result in a time-pressure curve having a desired shape and duration.

25 Claims, 4 Drawing Sheets

ENERGY DENSE EXPLOSIVES

BACKGROUND OF THE INVENTION

1. Field of the Invention

The invention relates generally to the field of explosives, and particularly to high explosives.

2. Background Information

Ongoing efforts to enhance national security by improving the performance, efficiency and cost-effectiveness of munitions demonstrate a continuing need to develop munitions that have a greater energy density with respect to both mass and volume.

SUMMARY OF THE INVENTION

Exemplary embodiments of the invention provide energy dense explosives that possess significant advantages, particularly when used in military munitions. In particular, embodiments of the invention include high explosive formulations that have a high mass density and a high energy per unit volume. Exemplary embodiments of the invention have ingredients including a reducing metal and a particulate metal oxide dispersed throughout a primary explosive material. Upon detonation of the explosive, the reducing metal and the particulate metal oxide combine in a "redox", or "thermite", reaction and add energy to the event. In accordance with exemplary embodiments of the invention, the reducing metal and the particulate metal oxide can be used to tailor blast characteristics of a munition, for example to result in a time-pressure curve having a desired shape and duration.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

In accordance with embodiments of the invention, the mass per unit volume density of high explosive formulations is increased, and at the same time explosive energy can be added to the formulations.

Figure 1:
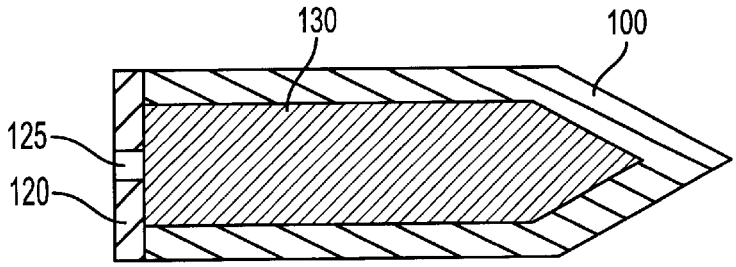
FIG. 1 shows a munition containing energy dense explosive in accordance with exemplary embodiments of the invention.

These results can be accomplished by adding a finely particulate metal oxide and a reducing metal to each primary explosive formulation to form an EDE (Energy Dense Explosive). FIG. 1 shows an exemplary munition incorporating EDE 130 within a warhead case 100 having an end cap 120 with a fuze 125 for detonating the EDE 130.

Upon ignition or detonation of the EDE formulation, the finely particulate metal oxide and the reducing metal will react to produce a metal and a new oxide by reacting the oxygen of the finely particulate metal oxide with the reducing metal. This class of chemical reaction is termed a "redox" or "thermite" reaction. A familiar, well-known example of this general class of chemical reaction is the reaction of iron oxide with aluminum to produce metallic iron and aluminum oxide with a release of heat energy on the order of a thousand calories per gram of reactants. In this context, a calorie is an amount of heat necessary to raise the temperature of one gram of water one degree Centigrade from a standard initial temperature, at one atmosphere of pressure.

There are many possible redox reactions possible among about 100 metal oxide candidates and about 15 candidate reducing metals. A generalized formula for the stoichiometry of the reactions is:

$$M_xO_y+M_z=M_x+M_zO_y+\text{Heat}$$

where $M_xO_y$ is any of several metal oxides, $M_z$ is any of several reducing metals, $M_x$ by itself is the metal liberated from the original oxide and the new oxide is $M_zO_y$.

Different embodiments of the invention can incorporate, for example, various ones of five primary objectives when formulating energy dense explosives (EDE). First, to maximize an energy per unit volume density by appropriately mixing the densest combination of [1] primary explosive; [2] energetic polymer binder; [3] metal oxide; and [4] reducing metal. Second, to control energy per unit volume density of the EDE so that the resulting density optimizes weapon performance and is both greater than energy densities of well-known conventional explosives, and less than a maximum practical energy density. Third, to formulate EDE compositions that can be either vacuum cast into warheads, like the well-known high explosive PBXN-109, or cartridge-loaded into warheads as a structurally compatible billet. Fourth, to formulate EDE compositions that minimize production cost. Fifth, to formulate safe EDE explosives that are insensitive to thermal and physical shock, for example vibration or abrupt acceleration, that are chemically stable, and which can be safely, effectively and efficiently demilitarized at the end of their service life.

In general, EDE compositions enable greater design flexibility in munitions, wherein warheads of fixed geometric size can be increased either in weight or ability to deliver energy, or both. In munitions or warheads of fixed weight a greater amount of energy can be packed into a smaller contained volume, allowing the warhead to be designed so that is smaller and has greater hard target penetration and/or increased energy delivery for its total weight. EDE formulations in accordance with exemplary embodiments of the invention are basically conventional explosives mixed with polymer binder, metal oxide and reducing metal ingredients. The conventional explosives can be, for example, polymer based explosives such as PBXN-109 or PBX-108 or AFX-757 composed of RDX, aluminum and rubber binder. The AFX-757 formulation includes, in addition, a portion of ammonium perchlorate or other appropriate oxidizer which replaces some of the primary explosive, RDX.

In accordance with exemplary embodiments of the invention, EDE formulations can be used to increase blast and fragmentation energy as well as hard target penetration in AUP (Advanced Unitary Penetration) warheads.

The AUP warhead design includes a strong steel case to maximize its ability to penetrate hard targets, at the expense of sacrificing explosive energy delivered to the target. A portion of the steel in the case is allocated to serve as ballast in the warhead, to increase the hard target penetration by, for example, increasing kinetic energy and the sectional density (mass per unit of frontal area) of the warhead. This ballast serves no first order structural purpose.

Figure 2:
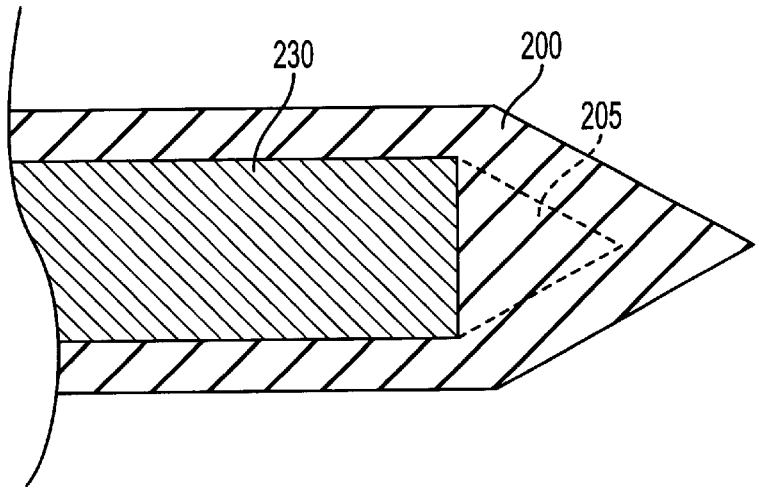
FIG. 2 shows a portion of a munition containing energy dense explosive in accordance with exemplary embodiments of the invention.
Figure 3:
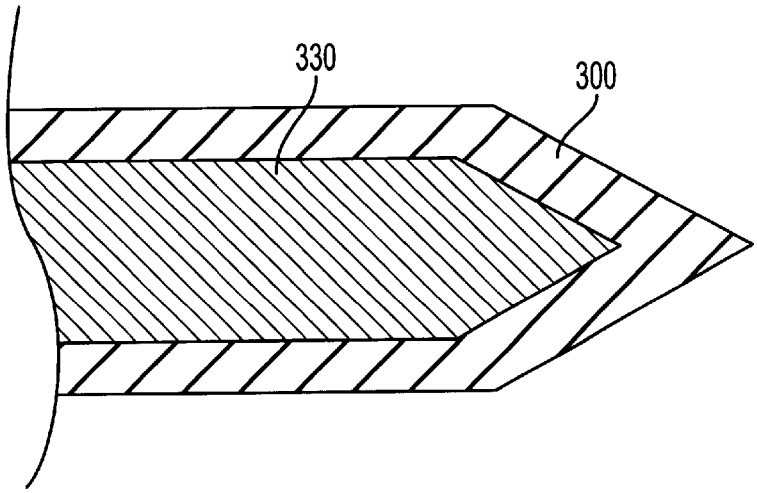
FIG. 3 shows a portion of a munition containing energy dense explosive in accordance with exemplary embodiments of the invention.

FIG. 2 shows an example of this principle, where a portion 205 of a warhead case 200 is allocated as ballast. In particular, consider the situation where a conventional AUP warhead contains a conventional explosive which has a lower mass per unit volume density than that of the material of the warhead case. Given an EDE formulation which has a mass per unit volume density that is greater than the density of the conventional explosive, the conventional explosive can be replaced with the EDE formulation to result in a warhead that has the same external dimensions as before but has an increased mass, and therefore an increased sectional density and increased penetration. Given that the EDE formulation has an energy per unit volume density that is greater than that of the conventional explosive, the warhead will also have increased energy. As shown in FIG. 3, energy of the warhead can be further increased by replacing the ballast portion 205 of the warhead case with the EDE formulation.

In accordance with an exemplary embodiment of the invention, the energy of a warhead containing conventional explosive and having an inert ballast portion, can be increased without changing the external dimensions or the mass of the warhead by replacing the conventional explosive with an equal mass of an EDE formulation having energy per unit volume and mass per unit volume densities that are greater than those of the conventional explosive. Where the mass per unit volume density of the EDE formulation is greater than that of the conventional explosive and less than that of the warhead case material, the conventional explosive can be replaced without creating voids within the warhead. This is done by replacing the conventional explosive within the warhead and some or all of the inert ballast portion of the warhead with a quantity of EDE that has the same total mass and volume as the combined quantity of conventional explosive and inert ballast portion it replaces. The amount of inert ballast that is replaced, and/or the particular mass per unit volume density of the EDE formulation, can be appropriately selected to ensure that the replacement quantity of EDE has the same total mass and volume as the combined quantity of conventional explosive and the inert ballast portion that it replaces.

Thus, EDE compositions can be used in accordance with exemplary embodiments of the invention to do one or more of (a) increase the mass of a munition, (b) increase the energy of the munition, and (c) decrease the size of the munition.

Tables 1–3 below show exemplary EDE formulations 1.001, 1.002 and 1.003 with component proportions by weight, that can be used in various embodiments of the invention.

TABLE 1

| EDE - 1.001 | |
|---|---|
| Polymer | 0.0593 |
| RDX | 0.2330 |
| $Wo_2$ | 0.4970 |
| Zr | 0.2107 |
| | 1.0000 |

Density = 0.163 lbs/in$^3$ = 4.53 grams/cc
Energy = 689 calories/gram = 3121 calories/cc

TABLE 2

| EDE - 1.002 | |
|---|---|
| Polymer | 0.084 |
| RDX | 0.292 |
| Al | 0.115 |
| CuO | 0.509 |
| | 1.000 |

Density = 0.1122 lbs/in$^3$ = 3.12 grams/cc
Energy = 1,064 calories/gram = 3320 calories/cc

TABLE 3

| EDE - 1.003 | |
|---|---|
| Polymer | 0.045 |
| RDX | 0.093 |
| A.P.* | 0.122 |
| Al | 0.120 |
| $WO_2$ | 0.620 |
| | 1.000 |

Density = 0.1379 lbs/in$^3$ = 3.831 grams/cc
Energy = 973 calories/gram = 3728 calories/cc
*A.P. = Ammonium Perchlorate In particular, the EDE formulation EDE-1.001 enables design of a warhead that is the same size and weight as the present AUP-1 design that is currently used by the U.S. military, that will deliver an increased heat energy that is about 3 times that of the conventional AUP-1 design as it is presently equipped with the PBXN-109 conventional explosive.

Table 3.1 shows comparisons between a) conventional explosives AFX-757, PBXN-109, and PBXC-129, and b) EDE compositions EDE-1001, -1002.

TABLE 3.1

| Explosive | Density (lbs/in$^3$) | Energy (calories/cm$^3$) |
|---|---|---|
| AFX-757 | 0.067 | 2270 |
| PBXN-109 | 0.060 | 1748 |
| PBXC-129 | 0.0614 | 2300 |
| EDE-1001 | 0.163 | 3120 |
| EDE-1002 | 0.112 | 3320 |

In accordance with another exemplary embodiment of the invention, the EDE-1.001 formulation can be used in a modification of the J-1000 warhead to result in a redesigned warhead that has the same total mass and the same length of 72-inches, but with a reduced frontal cross section. The conventional J-1000 warhead is currently used by the U.S. military. The redesigned J-1000 warhead is, for example, capable of providing hard target penetration that is 44 percent greater than the conventional J-1000, with a delivered energy that is the same as for the conventional J-1000 warhead. Penetration performance can be traded downward from this point for increases in delivered energy. For example, portions of the J-1000 warhead casing can be replaced with EDE-1.001. Generally, increasing sectional density enhances penetration of hard targets.

Warheads have been designed in accordance with the TUNG5 concept developed by the U.S. Air Force/Eglin/HERD. In a "TUNG5" warhead design, a Tritonal™-based explosive is ballasted with admixed finely particulate tungsten metal powder. The tungsten serves only to increase the mass of the warhead; its influence on delivered energy for a given volume is negative. The tungsten appears to act as a heat sink during reaction of the TNT in the composition. The explosive energy of the "TUNG5" formulation in an AUP-3 warhead was calculated to be equivalent to about 67 pounds of Tritonal™ explosive. When the EDE-1.001 formulation is used to replace the "TUNG5" formulation in the AUP-3 warhead, the penetration performance remains the same while delivered energy is greatly increased. For example, characteristics such as W/A (where W is the weight of the weapon, and A is the cross-sectional area of weapon), nose factor (which is a length of the weapon nose expressed in calibers, where 1 caliber=1 diameter of the weapon), etc. remain the same, but the energy delivered to the target is increased up to fourfold.

In accordance with other exemplary embodiments of the invention, EDE formulations can be tailored to obtain desired peak detonation pressures and/or pressure vs. time impulse profiles. When an EDE composition is detonated, the fine redox powders dispersed through the EDE composition react in a redox reaction at speeds comparable to detonation speeds of conventional explosives. Thus, the redox reaction injects energy into the detonation reaction quickly enough to promote increases in both peak detonation pressure and blast impulse magnitudes.

The premise here is that particulate sizes of the metal-oxide thermogen components of the redox reaction can influence a rate of the redox reaction or a rate at which redox reaction energy is delivered, during a time interval on the order of 1 to 1000 microseconds. Accordingly, the energy release rate can be regulated by appropriately selecting particle sizes of the metal oxide redox components. In this way tradeoffs can be achieved between detonation peak pressure and blast impulse. Thus, in accordance with exemplary embodiments of the invention, munitions can be developed that are especially effective on certain classes of targets. For example, EDE formulations can be used to generate a longer blast impulse profile for classes of targets that are more damage-susceptible to impulse than to peak pressure.

In addition, a packing density of solid particulates in a matrix of an EDE formulation can also be influenced by selecting particle sizes of thermogen components, because the packing density is a function of the size distributions of the particles in the matrix.

In terms of explosive hazard, chemical stability, and life cycle properties, redox components $M_xO_y+M_z$ are individually and in combination nearly inert by ordinary standards of flame or explosion hazard. A temperature of over 1,000 degrees Fahrenheit or a strong, primary explosive shock is typically required to initiate the redox reaction. Redox components are safe and chemically compatible with conventional explosives used to make EDE compositions. For example, Redox components are safe and chemically compatible with both the Tritonal™ explosive and with tar warhead liners, and EDE compositions should be as stable as current, qualified PBX explosives currently in use, in all phases of the EDE munition life cycle.

In particular, EDE compositions are anticipated to be safe for in situ detonation or burning. Environmentally safe reclamation of EDE compositions can also be feasible as well as cost effective. Components of EDE compositions can be separated, and thus high value components such as metals, metal oxides and crystalline high explosive material can be recovered from decommissioned EDE munitions.

In accordance with principles of the invention, the mass per unit volume density of high explosive formulations is increased while at the same time explosive energy is added to the formulations. As described above, this can be done in accordance with exemplary embodiments of the invention by adding a finely particulate metal oxide and a reducing metal to the high explosive formulations, so that when the high explosive reacts, the reducing metal and the metal oxide react together to produce a metal from the metal oxide and a new oxide made of the oxygen and the reducing metal.

U.S. Pat. No. 3,745,077, issued on Jul. 10, 1973 to J. W. Jones and entitled "Thermit Composition and Method of Making", describes methods for making structurally strong thermite compounds for which the name "Cermet" was coined. The report also generally discusses thermite reactions. U.S. Pat. No. 3,745,077 is hereby incorporated by reference.

There are many redox reactions possible among about 100 metal oxide candidates and about 15 candidate reducing metals. As indicated above, the generalized formula for the stoichiometry of a redox reaction is:

$$M_xO_y+M_z=M_zO_y+\text{Heat} \quad (1)$$

where MxOy is any of several metal oxides, Mz is any of several reducing metals, Mx by itself is the metal liberated from the original oxide, and the new oxide is $MzO_y$. Table 4 provides a partial listing of metals and metal oxides that are candidates for practical heat production in an EDE formulation.

In accordance with an exemplary embodiment of the invention, an overall mass per unit volume density of the thermogen component pair, i.e., the reducing metal and the metal oxide, can range from a lower limit of about 0.065 pounds per cubic inch. The upper limit can be the highest mass per unit volume density possible with a thermogen pair, a density near 0.28 lbs/in.

Turning to Table 4, only representative, common oxides are listed in the third column.

TABLE 4

| Element Symbol | $T_{melt}$ (° C.) | Oxide Formula | $T_{melt}$ (° C.) | Density Elem. (gm/cc) | Oxide (gm/cc) |
|---|---|---|---|---|---|
| La | 920 | $La_2O_3$ | 2315 | 6.15 | 6.51 |
| Ca | 843 | CaO | 2580 | 1.55 | 3.37 |
| Be | 1278 | BeO | 2530 | 1.85 | 3.01 |
| Th | 1700 | $ThO_2$ | 3050 | 11.2 | 10.03 |
| Mg | 651 | MgO | 2800 | 1.74 | 3.58 |
| Li | 179 | $Li_2O$ | >1700 | 0.534 | 2.013 |
| Sr | 769 | SrO | 2430 | 2.6 | 4.7 |
| Zr | 1852 | $ZrO_2$ | 2715 | 6.4 | 5.49 |
| Al | 660 | $Al_2O_3$ | 2015 | 2.702 | 3.97 |
| U | 1133 | $UO_2$ | 2500 | 18.7 | 10.9 |
| Ba | 725 | BaO | 1923 | 3.5 | 5.72 |
| Ce | 640 | $CeO_2$ | 2600 | 6.8 | 7.3 |
| B | 2070 | $B_2O_3$ | 450 | 2.3/3.3 | 1.844 |
| Ti | 1800 | $TiO_2$ | 1840 | 4.5 | 4.26 |
| Si | 1410 | $SiO_2$ | 1703 | 2.42 | 2.32 |
| V | 1890 | $V_2O_5$ | 690 | 5.96 | 5.76 |

TABLE 4-continued

| Element Symbol | $T_{melt}$ (° C.) | Oxide Formula | $T_{melt}$ (° C.) | Density Elem. (gm/cc) | Oxide (gm/cc) |
|---|---|---|---|---|---|
| Ta | 2996 | $Ta_2O_5$ | 1800 | 16.6 | 8.2 |
| Na | 97.8 | $Na_2O$ | 12.75 | 0.97 | 2.27 |
| Mn | 1244 | $MnO_2$ | | 7.2 | 5.03 |
| Cr | 1890 | $Cr_2O_3$ | 2435 | 7.2 | 5.21 |
| Zn | 419 | ZnO | 1975 | 7.14 | 5.47 |
| K | 63.65 | $K_2O$ | | 0.84 | 2.32 |
| P | 590 | $P_2O_5$ | 582 | 2.34 | 2.39 |
| Sn | 232 | $SnO_2$ | 1127 | 5.75 | 6.95 |
| W | 3410 | $WO_3$ | 1473 | 19.3 | 7.16 |
| Fe | 1535 | $Fe_3O_4$ | | 7.86 | 5.18 |
| Mo | 2610 | $MoO_3$ | 795 | 10.2 | 4.5 |
| Cd | 321 | CdO | <1426 | 8.64 | 8.15 |
| Ni | 1453 | NiO | 1990 | 8.90 | 7.45 |
| Co | 1495 | CoO | 1935 | 8.90 | 5.7/6.7 |
| Sb | 631 | $Sb_2O_3$ | 656 | 6.68 | 5.2 |
| Pb | 328 | PbO | 888 | 11.35 | 9.53 |
| Fe | 1535 | $Fe_2O_3$ | 1565 | 7.86 | 5.24 |
| Cu | 1083 | $Cu_2O$ | 1235 | 8.92 | 6.0 |
| Cu | 1083 | CuO | 1320 | 8.92 | 6.4 |

Most metals have more than one possible, stable naturally occurring or manufactured, chemically distinct oxide compound. For example, the possible tungsten oxides and their densities are:

TABLE 5

| Oxide | Density |
|---|---|
| WO3 | 7.16 grams/cc |
| WO2.9 | 8.60 |
| WO2.72 | 7.68 |
| WO2 | 12.11 |

These are four of the six densest common oxides; the other two are lead monoxide [9.53 g/cc] and nickel monoxide [7.45 g/cc]. Tungsten dioxide is uniquely the densest oxide and is a preferred candidate for formulation of the densest EDEs.

Referring again to Table 4, the order of listing of elements and oxides is in descending order of the free energy of formulation of the oxides. In principle, any metal in the listing will reduce any oxide lower in the listing to produce free metal from the oxide as well as the new oxide of the reducing metal. In fact, for the actual reactions to be self sustaining at ordinary temperature, an exotherm of about 400 calories per gram is needed at ordinary temperature and pressure (77° F., 14.7 p.s.i.a). Among the candidate reducing metals, attention focuses on aluminum and zirconium as leading candidates for the reducing metal component of EDE formulations. The other candidates include Thorium, Calcium, Magnesium, Uranium, Boron, Cerium, Beryllium and Lanthanum. These other candidates are variously (a) chemically hazardous, (b) poisonous, (c) radioactive, (d) low in density, and (e) costly. In some EDE applications they may be especially appropriate, but for general applications the field of interest for EDE is focused on the following oxides and reducing metals shown in Table 6.

TABLE 6

| Reducing Metal | Metal Oxide | Metal Density | Oxide Density |
|---|---|---|---|
| Aluminum | Tungsten Dioxide | 2.7 | 12.11 |
| Zirconium | Lead Monoxide | 6.4 | 9.53 |

TABLE 6-continued

| Reducing Metal | Metal Oxide | Metal Density | Oxide Density |
|---|---|---|---|
| [alloys/inter metallics of Zr + Al] | Tungsten 2.72 Oxide | | 8.6 |
| | Tungsten 2.90 Oxide | | 7.68 |
| | Nickel Monoxide | | 7.45 |
| | Tungsten Trioxide | | 7.16 |
| | Tennorite [CuO] | | 6.4 |
| | Cuprite [Cu2O] | | 6.0 |
| | Manganese Dioxide | | 5.03 |
| | [Or mixtures of these oxides] | | |

By inspection, the potentially best composition for high density is zirconium and tungsten dioxide. However, for a given application, the best compromise of energy and density may not be intuitively obvious since the heat liberated by the reaction is a strong exponential function of the atomic weight of the reducing metal. For example, stoichiometric mixtures of tungsten trioxide with aluminum [atomic weight=27] or zirconium [atomic weight=91] yield, respectively, 710 calories/gram for Aluminum and 530 calories/gram for Zirconium. Further, heat evolution, or in other words an amount of heat released by the chemical reaction, is influenced by the oxides used.

For example, a mixture of manganese with tungsten dioxide reduced by aluminum, zirconium or intermetallics of zirconium and aluminum yields a continuous spectrum of heat release potential between 530 calories per gram and 1200 calories per gram, and a possible range of composition densities [of oxides+metal] extending from about 5 grams per cc (cubic centimeter) to about 10 grams per cc.

Energy vs mass per unit volume density trades show that less dense oxides can optimize warhead energy potential of EDE, and can be used to guide selection of an oxide for use in an EDE formulation. Such trades are computationally tedious but technically uncomplicated, and can be especially useful because of the large numbers of possible chemical specie that can exist either on a transient or stable basis during/after the reaction.

In order for EDE formulations to efficiently generate blast energy, in accordance with exemplary embodiments of the invention the thermogen components are configured to complete their redox reaction within less than one millisecond. Toward that end, the use of very finely particulate material is desirable. For example, thermogen component particles can be in the range of 1 micron to 1 nanometer. In accordance with exemplary embodiments of the invention, particle sizes of the thermogen components can also range between 1 and 10 microns. The particle sizes can also be larger than 10 microns. Aluminum and Zirconium as well as Tungsten oxides are all available as particles in, and below, the micron size range.

In exemplary EDE formulations, the finely particulate metal, the metal oxide and the high explosive are suspended and dispersed in a polymeric compound that functions as a binder or matrix. An average separation between the finely particulate metal and the metal oxide within the matrix can be, for example, on the order of the size of the metal and metal oxide particles. When the high explosive is detonated, the action of the explosive itself creates a hot plasma in which the redox reaction of the reducing metal and the metal oxide is initiated rapidly in the plasma. The plasma can aid or enhance the redox reaction, for example by providing free electrons that facilitate the redox reaction. When the polymeric binder is formed of an energetic polymer, energy released by the polymer upon detonation of the high explosive can enhance the formation of hot plasma in which the redox reaction can take place. The resulting release of heat in the redox reaction can occur at a speed comparable to detonation reactions per se. Confinement of the EDE can be a factor of first order importance. Strong containment by a penetrating warhead casing slows expansion of the explosive plasma, which can allow the redox reaction to progress to completion more efficiently inside the plasma.

In accordance with another exemplary embodiment of the invention, particles of reducing metal are mechanically bonded to particles of metal oxide prior to suspension in the polymer in order to achieve an intimate contact between the reducing metal and the metal oxide particles. There are several ways this can be done.

For example, the reducing metal can be adhered onto the metal oxide using a vapor phase coating process similar to the Powdermet, Inc. process for coating iron and nickel onto metallic tungsten particles. Alternatively, the metal oxide can be coated onto the reducing metal using similar techniques.

As an alternative to the vapor phase coating technique, electroless plating techniques for placing metallic coatings on a variety of substrates can be adapted to coat the metal oxide with the reducing metal.

In both of these techniques, thicknesses of the coating can be controlled to influence a speed of the redox reaction upon detonation of the high explosive. In general, thinner coatings favor faster reactions.

As a further alternative, the necessary proximity between reducing metal and metal oxide thermogen components can be relaxed or increased by selecting reactive binders such as Teflon, Viton or those used in proprietary rocket propellants. These materials improve the efficiency of plasma formation and thereby increase a maximum allowable distance between thermogen components or component particles.

Another technique is to use powdered Cernet™ material as the thermogen component pair. Powdered Cermet™ can be obtained by grinding Cermet™ material into a powder whose particles will, on average, have a correct combination of reducing metal and oxide. The size of the particles can also be controlled to regulate a speed of the redox reaction that occurs upon detonation of the high explosive. For example, reaction speed can be increased by reducing the particle size. When Cermet™ is used to create an EDE formulation, consideration should be given to the possibility that residual borides will be formed when the munition is detonated, because some of them can be toxic. Boron is present in Cermet™ EDE formulations because boric oxide is used to bond the metal and the oxide together in Cermet™.

As a further alternative, the metal oxide (or the reducing metal) can be coated with molten boric anhydride. This composition, once cooled, can then for example be ground into blended aluminum-boric oxide particles having a desired size.

Ammonium perchlorate can also promote formation of plasma conditions that are conductive to stimulating a redox reaction of the metal-oxide components during explosion of the EDE formulation.

The role of metals in conventional and EDE formulations will now be addressed. Aluminum is conventionally used in explosives such as Tritonal™ or PBXN-109 as a thermogen, i.e., an agent that adds thermal energy in the explosion process. To the extent that free oxygen is available in the explosive plasma initially formed in a bomb or warhead upon detonation, the aluminum reacts with this oxygen to produce aluminum oxide and significant additional heat. Most conventional explosives such as RDX produce little if any free oxygen in the explosion plasma, and therefore substantial amounts of hot aluminum particles disperse into ambient air during the course of the explosion. These hot aluminum particles burn as they come into contact with atmospheric oxygen. This "afterburning" produces a brilliant light flash that is characteristic of exploding warheads equipped with Tritonal™ or PBXN-109. The afterburning of aluminum particles adds energy to the blast, on a slower time scale than energy delivered by the primary explosive upon detonation, thereby enhancing the delivered blast impulse of the warhead.

To the extent that oxygen is made available to the plasma as the plasma initially develops, the thermogen works more efficiently. This latter point is well illustrated by conventional explosives that incorporate ammonium perchlorate, an oxygen-rich explosive ingredient, along with aluminum and explosives such as RDX or HMX. The addition of the perchlorate makes more oxygen available to the initial plasma, which speeds reaction of the metal thermogen and thereby releases energy with greater efficiency. This phenomenon is a part of the reason why the explosive formulation AFX-757, which contains ammonium perchlorate, is a more energetic blast explosive than PBXN-109, which does not contain ammonium perchlorate.

It is this latter phenomenon that EDE is intended to exploit, excepting that the focus of attention is on the denser oxides. For example, ammonium perchlorate has a density of 1.95 grams per cubic centimeter, compared to tungsten dioxide with a density of 12.11 grams per cubic centimeter. The candidate metallic oxides listed in the preceding are also different from ammonium perchlorate in that they are chemically more stable and require greater stimulus before giving up their oxygen to the reducing metal.

With respect to energetic polymer binders, as set forth above, energy released by the polymer binder upon detonation of the high explosive can enhance the formation of hot plasma in which the redox reaction can take place, thus promoting a desirably fast redox reaction. There are various polymers that are suitable for EDE compositions.

For example, fluoropolymers can be used to bind elements of EDE formulations together. Upon detonation or activation of the EDE formulation, the fluorine in the fluoropolymer oxizes the metal ingredient, thereby producing metallic fluorine compound[s] and releasing heat. The physical properties of fluropolymers are such that dense, pressed grains of fluoropolymer containing metals, ordinary explosives and metal oxides can be practically prepared. Fluoropolymers can be used in EDE formulations to enhance development of the plasma, as indicated above, and also to increase a mass per unit volume density of the EDE formulation. Density of commercially available fluoropolymers typically ranges between 1.7 and 2.15 grams per cc. Tensile strength and rigidity of the fluoropolymers are much higher than for PBAA-type binders, and therefore pressed EDE formulations incorporating fluoropolymers are strong and relatively rigid.

Energetic rubber binders can also be used to bind elements of EDE formulations together. For example, Thiokol Chemical Corporation's proprietary "GAP" binder can be used.

EDE formulations can be placed in warheads in different ways. For example, EDE formulations can be vacuum cast into a warhead, much the same as is done with PBXN-109. Mixing, transfer and casting can be performed under high vacuum to reduce porosity in the EDE formulation and thereby also the munition's sensitivity to autoignition or autodetonation when subjected to high accelerations which can occur, for example, when the munition impacts a target.

When a weapon impacts a target, the resulting deceleration of the weapon compresses the explosive charge in the weapon with a pressure that is proportional to the axial length of the charge multiplied by the mass per unit volume density of the charge. Under equal conditions of impact deceleration, an increase of 300 percent in mass per unit volume density of the explosive nominally triples the compression force at the head end of the explosive charge. In existing conventional weapons such as the AUP-3 and in the BLU-109/B, voids in either Tritonal™ or PBXN-109 explosive charges in the weapons can cause autoignition or autodetonation of the explosive charge on impact with reinforced concrete targets. It is possible that the process is complex in that friction from motion of the explosive in the bomb case, which is amplified by porosity, may be the actual culprit in ignition. However, eliminating voids in the explosive charge by mixing, transferring and casting the explosive in a vacuum prevents autoignition or autodetonation.

Extra care may be necessary when using TNT (trinitrotoluene) in EDE formulations, since TNT is a crystalline material that is typically cast into a bomb casing while in a molten state, and which shrinks as it passes from the molten to the solid state. While measures may be taken to reduce the amount of shrinkage, elimination of shrinkage cannot be done and formation of some porosity is inevitable. It bears note that cast TNT is more impact sensitive than PBX formulations.

Note that castability of EDE formulations is a function of total solids loading, particle size distributions, and particle shapes of the solid components. In accordance with an exemplary embodiment of the invention, the volume fractions of polymer and total solids loading are 20% and 80%, respectively. Of course, other suitable and appropriate volume fractions can also be used successfully, and can vary depending on the particular polymer binder used.

EDE material for use in explosive munitions can also be prepared as monolithic, pressed grains or as pressed grains in containing cartridges. These preparations are typically mechanically rather rigid bodies designed to be loaded into a munition and retained in place for service use of the weapon by adhesive or mechanical means.

Figure 4:
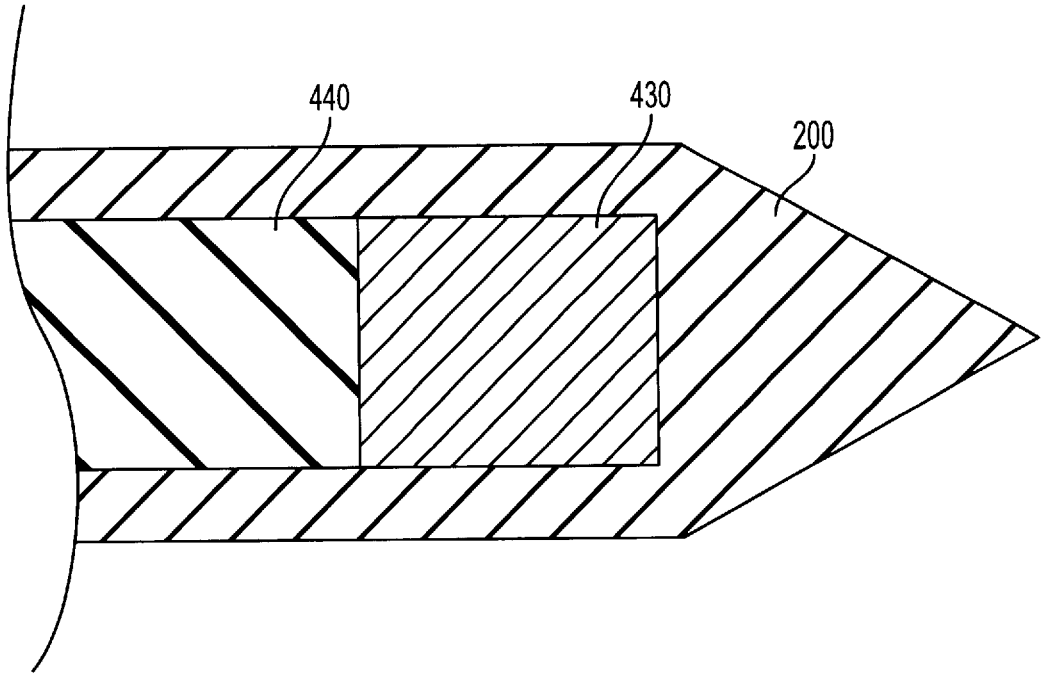
FIG. 4 shows a portion of a munition containing energy dense explosive in accordance with exemplary embodiments of the invention.

In accordance with an embodiment of the invention, a munition can contain both a conventional high explosive, as well as an EDE formulation. This is shown, for example, in FIG. 4, where a conventional high explosive 440 is located behind an EDE formulation 430 in the warhead case 200. Positions of the EDE formulation 430 and the conventional high explosive 440 can be reversed so that the EDE formulation 430 is behind the high explosive 440, and in general the different EDE and high explosive components can be located anywhere within the warhead case 200.

Figure 5:
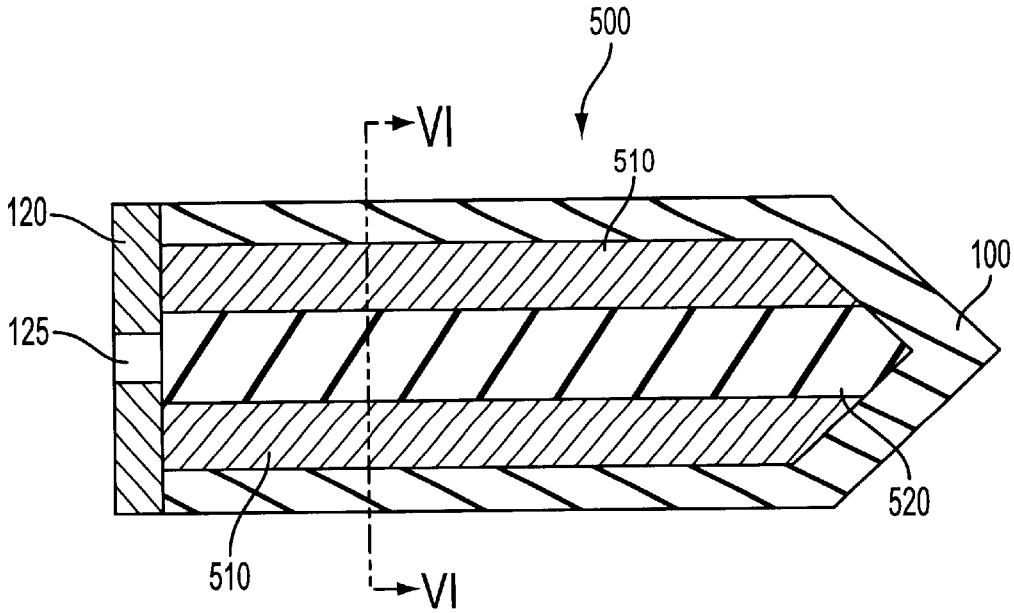
FIG. 5 shows a munition having multiple portions of EDE in accordance with an exemplary embodiment of the invention.
Figure 6:
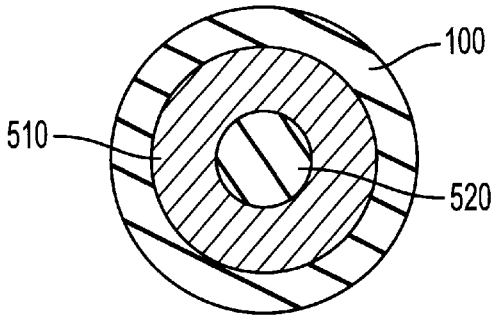
FIG. 6 shows a cross-section of the munition of FIG. 5.

In accordance with an exemplary embodiment of the invention, bi-component EDE explosive weapon loadings can be used. For example, as shown in FIGS. 5 and 6, the explosive load in a warhead 500 can include a central rod 520 of pressed EDE in an annulus 510 of cast EDE. Alternatively, the central rod 520 can be made of cast EDE, and the annulus 510 can be made of pressed EDE. Such designs can be considered to optimize such characteristics as mass per unit volume density, total energy, and reaction kinetics.

Figure 7:
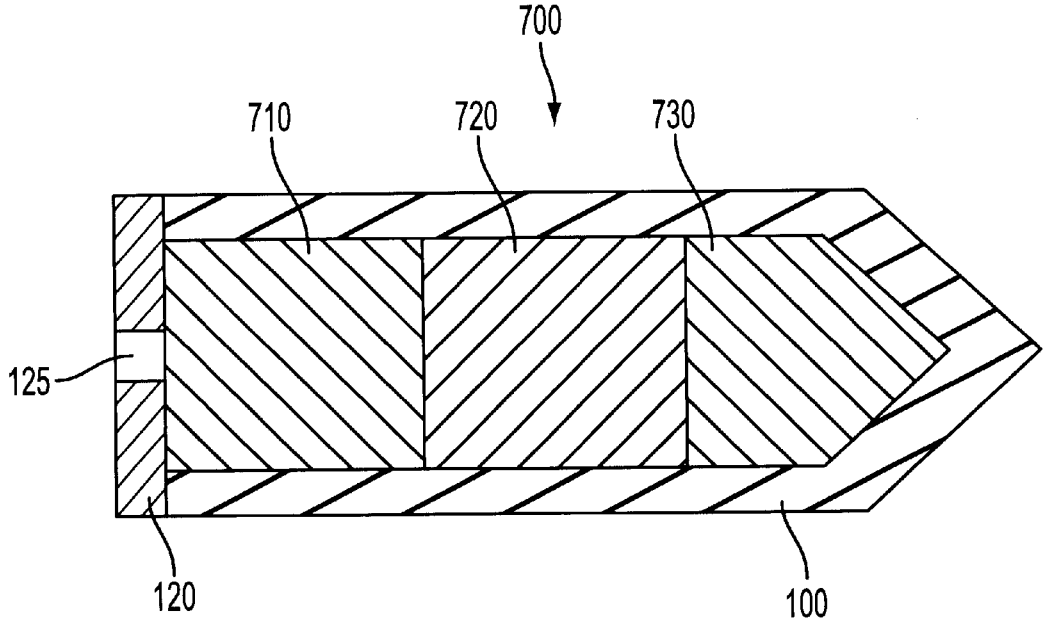
FIG. 7 shows a munition having multiple portions of EDE in accordance with an exemplary embodiment of the invention.

In accordance with another exemplary embodiment of the invention, different formulations can be located within the same warhead. FIG. 7 shows, for example, a warhead 700 having three different portions of EDE formulation 710, 720, 730. Each of the three portions can be a different EDE formulation, so that the portions have one or more of: (a) different redox components, (b) different base explosives, (c) different binders, (d) different redox particle sizes and/or proximities, (e) mass per unit volume densities, (f) energy per unit volume densities, and so forth. Differences between the portions can be, for example, for the purpose of tailoring blast characteristics, and/or weight and balance of the warhead 700. Any appropriate number of different portions of EDE formulation can be used, and as a further alternative the EDE material within the warhead can vary continuously. For example, the EDE material within the warhead can be configured so that characteristics of the EDE material vary continuously (a) from a front of the warhead to a rear of the warhead, (b) from a center of the warhead to an inner surface of the warhead casing, (c) radially outward from a central axis of the warhead, and so forth.

In addition, where an EDE is a mixture of a conventional explosive, one or more reducing metals, and one or more oxides, the amount of conventional explosive in the EDE can range from 5%–95% by weight of the EDE composition, and the dense additive can range from 5%–95% by weight of the EDE composition.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A munitions payload comprising:

a primary explosive;

a metal oxide dispersed within the primary explosive; and a reducing metal dispersed within the primary explosive, for reacting with the metal oxide;

wherein the payload does not contain abrasive components.

2. The payload of claim 1, wherein the metal oxide and the reducing metal are uniformly dispersed within the primary explosive.

3. The payload of claim 1, wherein the metal oxide and the reducing metal are non-uniformly dispersed within the primary explosive.

4. The munitions payload of claim 1, wherein an average density of the metal oxide and the reducing metal is at least about 5.0 grams per cubic centimeter.

5. The munitions payload of claim 1, wherein upon detonation of the primary explosive, a reaction between the metal oxide and the reducing metal occurs at a rate that is about the same as a rate of the detonation.

6. The payload of claim 5, wherein the detonation rate is on the order of 6 millimeters per microsecond.

7. The payload of claim 1 wherein upon detonation of the payload the metal oxide and the reducing metal completely react within 1 millisecond.

8. The payload of claim 1 wherein the payload further comprises a polymer binder for binding the primary explosive, metal oxide and reducing metal together.

9. The payload of claim 8, wherein the binder is a fluoropolymer.

10. The payload of claim 1 wherein the reducing metal is mechanically bonded to the metal oxide.

11. The payload of claim 10 wherein the mechanical bond is formed using boric oxide.

12. The payload of claim 10, wherein the reducing metal is adhered to the metal oxide using a vapor phase coating process.

13. The payload of claim 10, wherein the metal oxide is coated with the reducing metal via electroless plating.

14. The payload of claim 10, wherein the reducing metal and the metal oxide are in particle form, each particle comprising the reducing metal and the metal oxide.

15. The payload of claim 1 wherein each of the reducing metal and the metal oxide is in particle form.

16. The payload of claim 15, wherein the particles of reducing metal and the particles of metal oxide are greater than or equal to 1 micron and less than or equal to 10 microns across.

17. The payload of claim 15, wherein the particles of reducing metal and the particles of metal oxide are less than or equal to 1 micron across.

18. The payload of claim 15, wherein the particles of reducing metal and the particles of metal oxide are greater than or equal to 10 microns across.

19. The payload of claim 15, wherein sizes of the particles of reducing metal and the particles of the metal oxide are selected to tailor a peak detonation pressure of the payload.

20. The payload of claim 15, wherein sizes of the particles of reducing metal and the particles of the metal oxide are selected to tailor a time-pressure detonation impulse profile of the payload.

21. The payload of claim 1 wherein:

the reducing metal consists essentially of at least one of Aluminum, Zirconium, an alloy of Aluminum and Zirconium, and an intermetallic of Aluminum and Zirconium;

the metal oxide consists essentially of at least one of Tungsten Dioxide, Lead Monoxide, Tungsten 2.72 Oxide, Tungsten 2.90 Oxide, Nickel Monoxide, Tungsten Trioxide, Tennorite, Cuprite, and Manganese Dioxide.

22. A munitions payload comprising:

a primary explosive;

a metal oxide dispersed within the primary explosive; and a reducing metal dispersed within the primary explosive, for reacting with the metal oxide;

wherein the metal oxide and the reducing metal are non-uniformly dispersed within the primary explosive.

23. A munitions payload comprising:

a primary explosive;

a metal oxide dispersed within the primary explosive; and a reducing metal dispersed within the primary explosive, for reacting with the metal oxide;

wherein a mechanical bond is formed between the reducing metal and the metal oxide using boric oxide.

24. A munitions payload comprising:

a primary explosive;

a metal oxide dispersed within the primary explosive; and a reducing metal dispersed within the primary explosive, for reacting with the metal oxide;

wherein the reducing metal is adhered to the metal oxide using a vapor phase coating process.

25. A munitions payload comprising:

a primary explosive;

a metal oxide dispersed within the primary explosive; and a reducing metal dispersed within the primary explosive, for reacting with the metal oxide;

wherein the metal oxide is coated with the reducing metal via electroless plating.

* * * * *